United States Patent [19]

Thorpe

[11] Patent Number: 4,563,662

[45] Date of Patent: Jan. 7, 1986

[54] MOUNTING DIELECTRIC RESONATORS

[75] Inventor: William Thorpe, Felixstowe, England

[73] Assignee: British Telecommunications, London, England

[21] Appl. No.: 523,059

[22] Filed: Aug. 15, 1983

[30] Foreign Application Priority Data

May 25, 1983 [GB] United Kingdom ..... 8314460

[51] Int. Cl.[4] ..... H01P 7/00; H01P 1/207; H01P 1/203

[52] U.S. Cl. ..... 333/219; 333/202; 333/204; 333/208

[58] Field of Search ..... 333/202–212, 333/219–227; 428/901; 29/600; 331/96, 101, 102, 107 DP, 107 SL

[56] References Cited

U.S. PATENT DOCUMENTS

| | | | |
|---|---|---|---|
| 3,237,132 | 2/1966 | Okaya | 333/208 X |
| 4,028,650 | 6/1977 | Konishi et al. | 333/210 |
| 4,321,568 | 3/1982 | Joyal et al. | 333/209 |

FOREIGN PATENT DOCUMENTS 279127 4/1952 Switzerland .

OTHER PUBLICATIONS

Zeitschrift fur Angewandte Physik, vol. 24, No. 3, Mar. 1968, Berlin (DE), H. M. Muller: "Dielektrische Resonatoren und ihre Anwendungen als Mikrowellenfilter", pp. 142–147.

IEEE Transactions on Microwave Theory and Techniques, "Application of Dielectric Resonators in Microwave Components", by James K. Plourde et al., vol. MTT-29, No. 8, Aug. 1981.

IEEE Transactions on Microwave Theory & Techniques, vol. MTT-29, No. 4, Apr. 1981, pp. 323–326, New York (US), R. R. Bonetti et al.: "Designe of Cylindrical Dielectric Resonators in Inhomogeneous Media."

Patents Abstracts of Japan, vol. 6, No. 173, P (E-129) (1051), Sep. 7, 1982, and JP-A-5 7 91 001 (Matsushita Denki Sangyo KK) (07-06-1982).

*Primary Examiner*—Marvin L. Nussbaum

*Attorney, Agent, or Firm*—Cushman, Darby & Cushman

[57] ABSTRACT

A microwave dielectric resonator is supported between plural laminated layers of polymeric material having relatively lower dielectric constant.

16 Claims, 8 Drawing Figures

FIG. 1
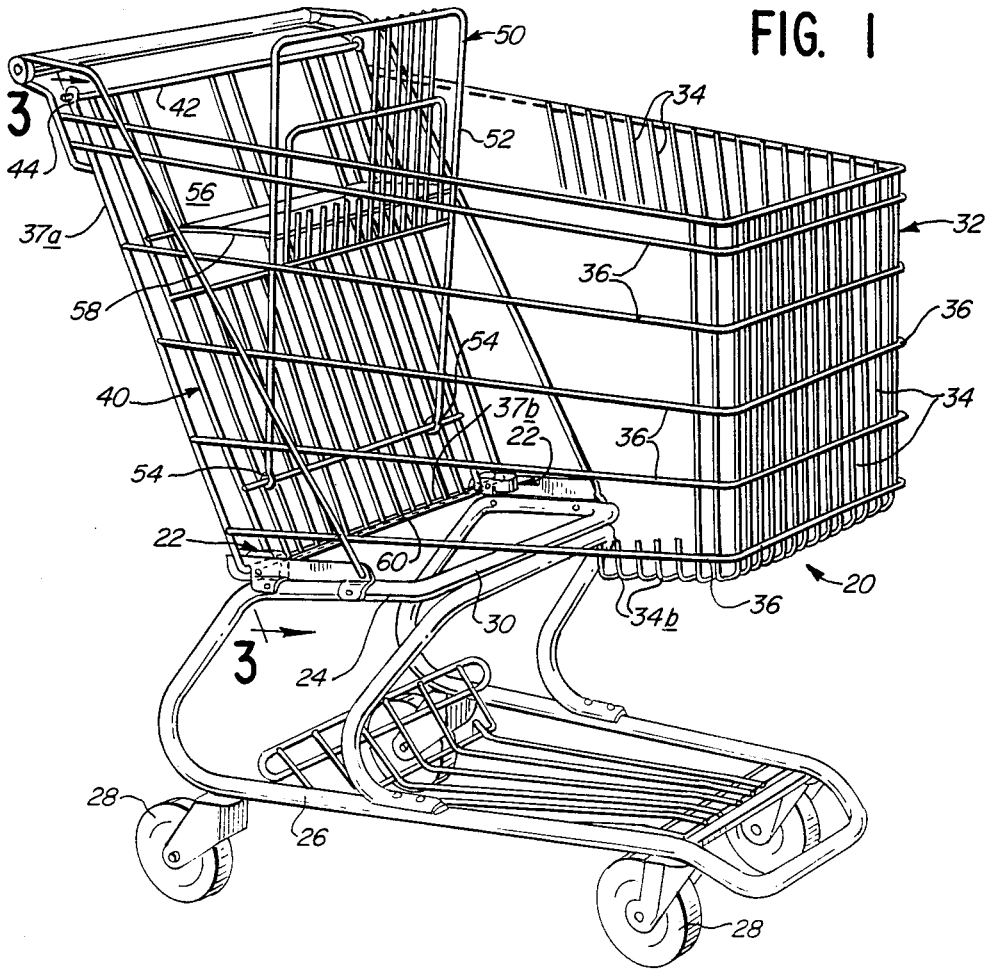
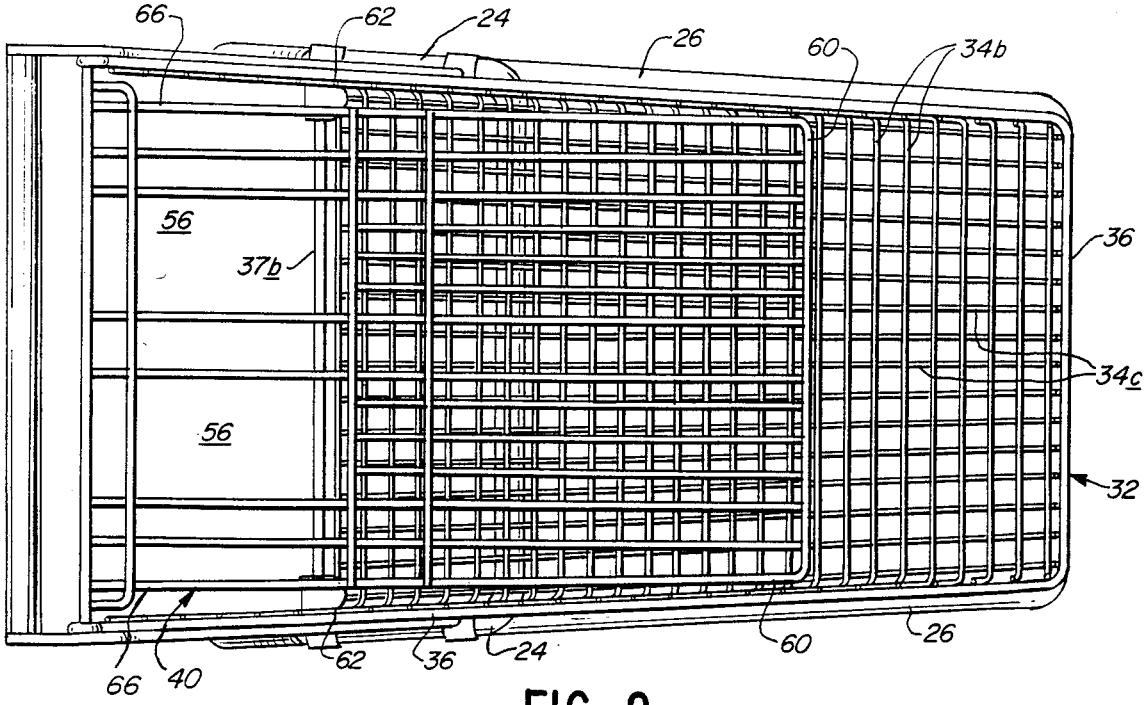
FIG. 2

FIG. 5
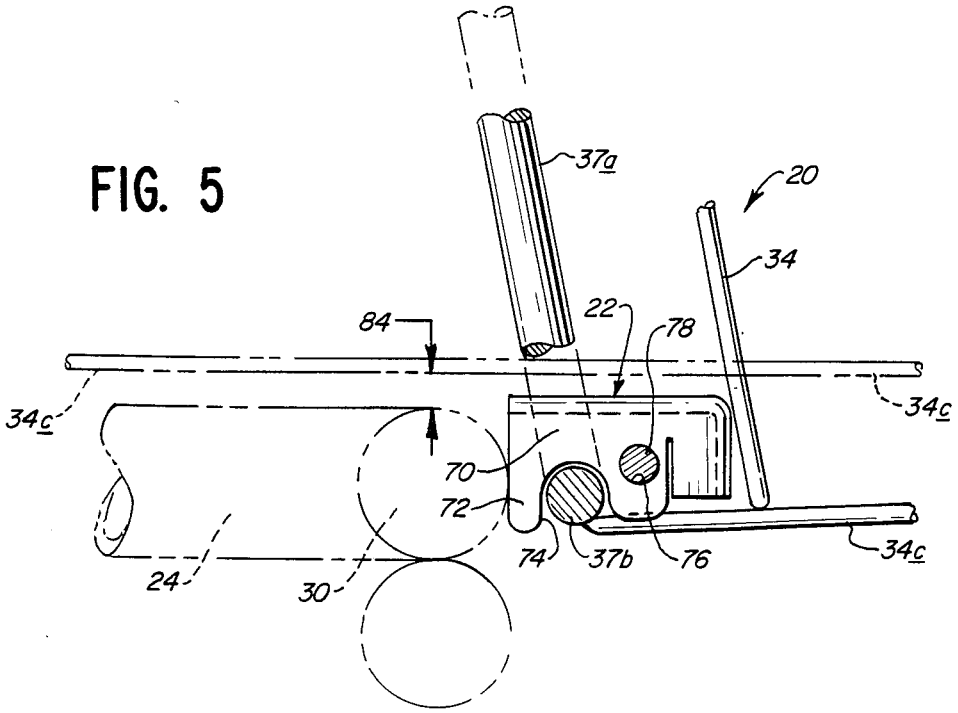
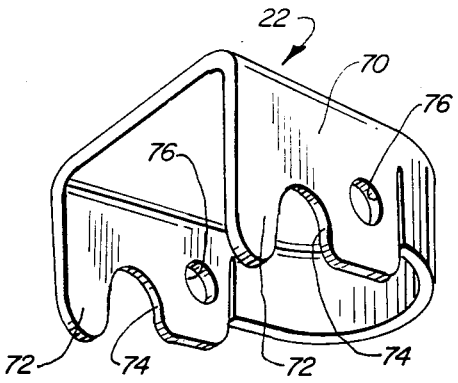
FIG. 6
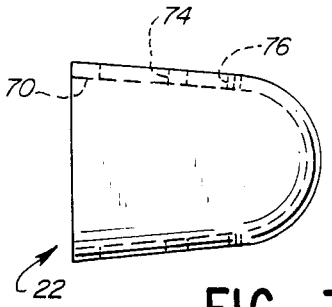
FIG. 7
FIG. 8
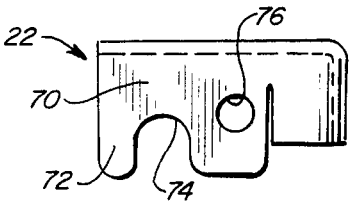

MOUNTING DIELECTRIC RESONATORS

This invention relates to dielectric resonators for use with microwaves, and in particular to the mounting of such resonators.

This application is related to the copending commonly assigned application of Gosling et al Ser. No. 672,235 filed Nov. 16, 1984.

Dielectric resonators, made from materials having a high dielectric constant (usually up to about 40) are used within microwave systems to reduce the space required for a resonator of any particular frequency. Whenever a dielectric resonator is used in a microwave system, whether in waveguide or microstrip applications, it is necessary to mount the resonator. It is known to bond dielectric resonators to a supporting substrate such as alumina by means of a glue or adhesive. It is also known to mount dielectric resonators by inserting them into holes machined in supports, as is shown for example in the review paper entitled "Application of Dielectric Resonators in Microwave Components" by James K Plourde and Chung-Li Ren, published in IEEE Transactions on Microwave theory and techniques; Vol. Mtt-29, No. Aug. 8, 1981.

Both these known techniques introduce losses, which may be considerable. Generally glues and adhesives are quite strong absorbers of microwaves, and even the small quantities which are used can cause appreciable loss.

Where the resonator is to be mounted within a waveguide, resonator supports machined to accept the resonator are in general quite bulky and may consequently cause appreciable loss, particularly where the dielectric constant of the support material (usually in the range 2 to 10) is much greater than 1. Furthermore, both the above techniques provide assemblies which are not particularly robust and which are sensitive to severe mechanical shock and vibration.

It is an object of the present invention to provide a technique for mounting dielectric resonators which introduces a minimal amount of loss and which may allow more rugged assemblies to be produced.

According to the present invention there is provided an assembly comprising a microwave dielectric resonator fixed between two polymeric layers of low dielectric constant, wherein the layers are heat bonded together.

By way of example only illustrative embodiments of the present invention will now be described with reference to the accompanying drawings in which:

FIG. 1 is a perspective view of a dielectric resonator positioned between a pair of low loss substrates.

FIG. 1A is an end elevation of the components of FIG. 1.

FIG. 2 is a perspective view of the components of FIG. 1 after lamination.

FIG. 2A is a sectional view along the line B—B of the laminated assembly of FIG. 2.

FIG. 5 shows how a laminated assembly may be mounted in a waveguide.

FIG. 6 shows how the technique may be used in the integration of microwave circuits.

Figure 3:
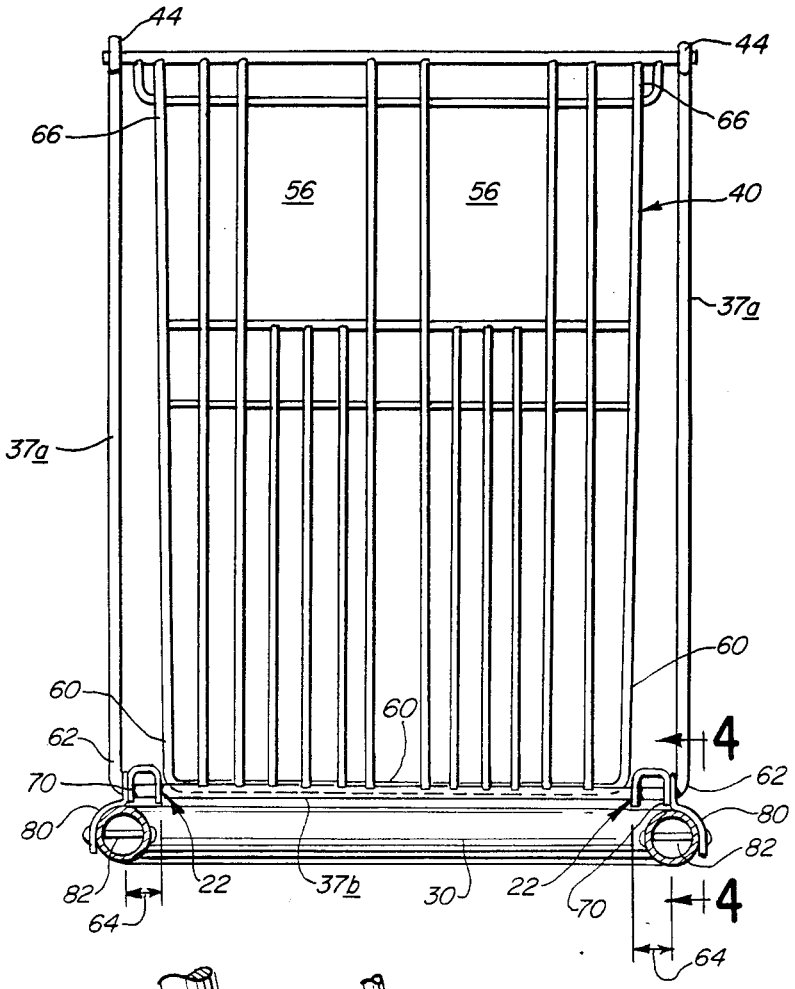
FIG. 3 is a perspective view of a jig for use in the lamination process.

Referring now to FIG. 1 and 1A, a dielectric resonator 1 is positioned between two sheets of a low dielectric constant substrate material 2 and 2'. The dielectric resonator is made of a material having a high dielectric constant such as Barium Titanate and may be of any conventional form, such as the circular pill shown. The substrate sections are of minimal thickness and are made of a polymeric material having a low dielectric constant. For ease of production the first substrate section 2 may be positioned to rest horizontally, the resonator 1 and second substrate section 2' being laid on top of the first section in preparation for the lamination stage.

The lamination is accomplished without the use of glues or adhesives in order to avoid the losses which such materials can introduce. In order to effect the lamination the two substrate sections 2, 2' are bonded together with the application of heat and pressure, although the actual method by which the bond is produced is not of primary importance provided that glues, adhesives and other lossy materials are avoided. As the dielectric resonator may be of quite considerable bulk (i.e. 2 mm diameter and 0.8 mm length for Q band resonators and up to about 5 mm diameter and 2 mm length for 9 GHz resonators), certainly in comparison to the substrate thickness ($\simeq$80 $\mu$m), it is generally necessary to apply the pressure needed to effect bonding through co-operating formers having recesses into which the resonator may be received during lamination. It is in general not necessary to exclude air from between the substrates when making the laminate, provided that the resulting laminate suficiently retains the resonator and provided that the laminate is not likely to catastrophically delaminate during its expected lifetime. If the encapsulated resonator is to be used in an environment where it will be exposed to elevated temperature and/or reduced atmospheric pressure, any gasses entrapped during the encapsulation process are likely to expand, which could cause a catastrophic failure of the encapsulation. For this reason it may be desirable to minimise the amount of gas entrapped during encapsulation.

The selection of a specific polymer for use in the method will depend largely on its physical properties. Among the most important of these properties are the electrical characteristics and those properties governing the ability to form a bond, between a substrate layer of that material and a further substrate layer, without the use of loss inducing materials (such as adhesives). Generally, when selecting a material for any particular application, advantages in respect of some of the properties will have to be balanced against disadvantages in respect of other properties For example, the polymers such as polyethylene, which most easily heat soften and which are correspondingly easy to heat bond, tend to have non-optimum electrical properties, e.g. undesirably high dielectric constants. Conversely, those polymers such as P.T.F.E., which have particularly desirable electrical properties may not be heat bondable directly because they do not heat soften.

With a material such as P.T.F.E. which does not readily heat soften, or a material such as oriented P.E.T. film, which may permanently lose considerably strength on being heated to near its softening point, it may be possible to produce what is in effect a self-bond, by the use of an interlayer 3 which is more readily heat softenable. The heat interlayer 3 may be a co-polymer having a monomer common to the principal layers, having a lower heat-softening temperature. With P.T.F.E., Du Pont's F.E.P., a co-polymer of P.T.F.E., has been found suitable.

As the interlayer need only be very thin, it is not essential that the interlayer material have electrical properties as good as those of the principal layers, provided that the resultant laminate's electrical properties are satisfactory. However, in order to satisfy the general requirements of low dielectric constant and low introduced loss it is important that the interlayer has a low dielectric constant and is of low loss, consequently conventional glues and adhesives cannot satisfactorily be used as interlayers as they are likely to cause excessive loss.

Figure 4:
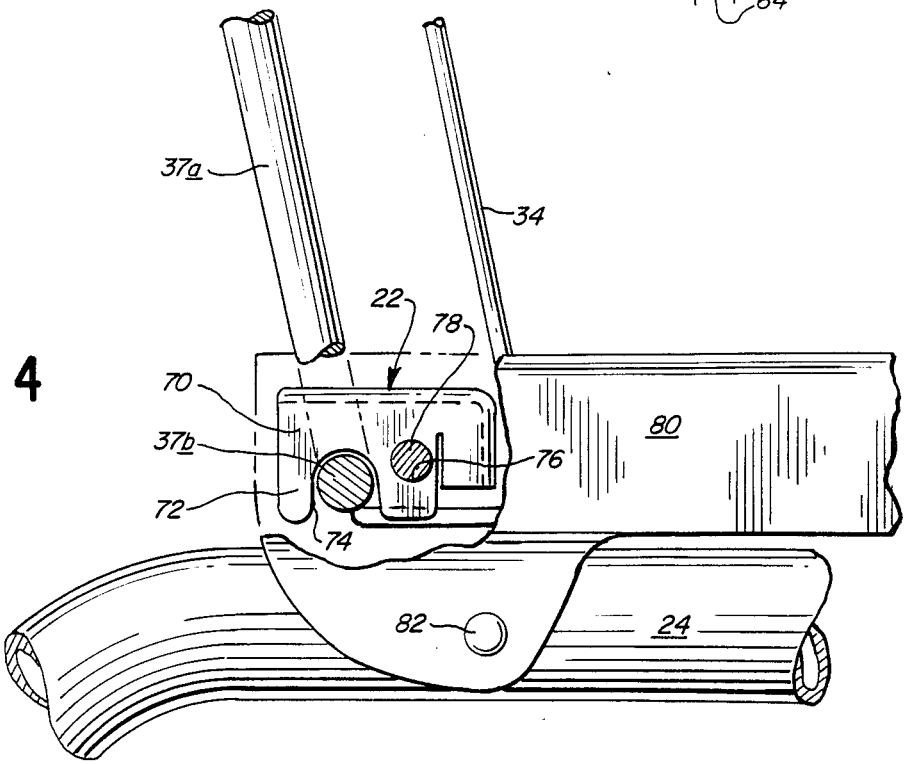
FIG. 4 is an end elevation of the jig of FIG. 3.

FIGS. 2 and 2A show a laminate 6 produced according to the invention. The laminate illustrated has been formed with the resonator centrally located between the substrate sections. The central location enables the resonator to be more easily located in the centre of a microwave cavity where housing effects and temperature fluctuations are minimised. FIGS. 3 and 4 show a jig in which a laminate may be produced. The jig comprises four plates; a pair of backing plates 10 and 10', and a pair of former plates 12 and 12' lying between the backing plates. Each backing plate is provided on one face with spigots 11 which co-operate with corresponding holes 13 in their respective former plates. The jig shown is intended for the production of laminates containing up to three resonators, their being three spigots spaced along the centre line of each backing plate and three holes in corresponding positions in each former plate. The height 14 of the spigots is less than the thickness 15 of the former plates 12 such that when the jig is assembled there is sufficient clearance between the opposing faces 16 and 16' of the spigots to accomodate a resonator. In addition to the spigots 11 and holes 13, the plates 10 and 12 may be provided with locating lugs 17 and sockets 18 to ensure accurate registration of the jig components when assembled.

In FIG. 5 a laminate 6 containing dielectric resonators 1, 1', 1'' is shown secured within a waveguide to produce a tuned cavity. The resonant frequency of the cavity being governed by the particular dielectric resonator or resonators chosen. The laminate 6 should be securely mounted within the waveguide to prevent its coming loose in the event of the waveguide, etc, being subjected to a severe mechanical shock. The laminate may be secured between grooves 9, 9' in the walls of the waveguide as shown, or in some other way which introduces the minimum amount of lossy material. If the laminate is securely mounted within the waveguide, the laminate's inherent toughness and resistance to shocks may be fully exploited in helping to make the equipment in which it is contained considerably less sensitive to shocks than is equipment which contains conventional resonator assemblies.

The lamination technique may also be applied to microstrip technology as shown in FIG. 6, in which a pair of substrate sections 19, 20 are laminated about microstrip transmission lines and conductors 21, and dielectric resonators 22, 22'. As in the preparation of a simple laminate, glues and adhesives are avoided and the substrates are of a low dielectric constant material.

The potential advantages of the technique include:

the possibility of reducing loss caused by the presence of the substrate material, as the substrate may be thinner than heretofore;

the possibility of eliminating loss caused by the presence of glues or adhesives;

the possibility of inreasing the shock resistance of the laminate as compared to assemblies where the resonators are mounted conventionally.

The reduction of loss due to the substrate mateial is a result of the reduction in thickness possible over previous structures. As no glues or adhesives are used during lamination they contribute no loss.

Where the laminate is adequately bonded it should be considerably more rugged than machined resonator assemblies.

A material which has been found to be suitable both for simple lamination to mount dielectric resonators for use in waveguides and for the lamination of microstrip components in addition to dielectric resonators is glass reinforced sheet P.T.F.E. sold under the trade name RT Duroid. RT Duroid is availble in the U.S. from Rogers Corporation, Box 700 Chandler, Ariz. AZ85 224, and in the UK from Mektron, 119 Kingston Road, Leatherhead, Surrey, KT22 7SU. The material has a dielectric constant of about 2.2 and is available in a range of thicknesses down to 80 m. Laminates have been made from this material with the use of an intermediate layer of fluorocarbon film (3M's type 6700 or Dupont FEP) placed between the substrate layers, bonding being achieved with the joint application of heat and pressure. Other suitable substrate materials include P.T.F.E. sheet, Mylar, and Kaptan.

The lamination technique may also be applied as a continuous process, where appropriate, in place of the one off process in which a jig, as shown in FIGS. 3 and 4, is used

EXAMPLE

Resonators 2 mm is diameter $\times$0.8 mm in length (i.e. thickness) were laminated between two sheets of RT Duroid 5890 80 $\mu$m thick using an intermediate bonding layer of 3M's 6700 fluorcarbon film 35 $\mu$m thick. Satisfactory lamination was achieved when a pressure of 100 p.s.i. was applied for 15 minutes at 200° C.

I claim:

1. An assembly comprising a microwave dielectric resonator fixed between two polymeric layers of low dielectric constant, wherein the layers are heat bonded together.

2. An assembly as claimed in claim 1 wherein one of said layers consists of a heat meltable polymer.

3. An assembly as claimed in claim 2 wherein said polymer is a thermoplastic.

4. An assembly as claimed in claim 1, wherein one of said layers consists essentially of a substantially non-heat meltable polymer.

5. An assembly comprising:

a microwave dielectric resonator fixed between two polymeric layers of low dielectric constant, wherein the layers are heat bonded together;

one of said layers consisting essentially of a substantially non-heat meltable polymer; and wherein said polymer layers are heat bonded together by means of an intermediate layer of lower melting point polymeric material of low dielectric loss.

6. An assembly as claimed in claim 5 wherein said intermediate layer consists essentially of a copolymer of a monomer common to one of said polymer layers.

7. An assembly as claimed in claim 5 wherein one of said layers consists essentially of a tetraflouroethylene polymer.

8. An assembly as claimed in claim 7 wherein said intermediate layer consists essentially of a flourocarbon compound.

9. An assembly as claimed in claim 8 wherein said flourocarbon compound is a copolymer of tetraflouroethylene.

10. A microwave filter comprising an assembly as claimed in claim 1.

11. A microstrip circuit comprising an assembly as claimed in claim 1.

12. A method of mounting a microwave dielectric resonator comprising the steps of positioning a dielectric resonator between two low dielectric loss polymeric layers, followed by the application of heat and pressure to effect a bond between said two layers.

13. A method of mounting a microwave dielectric resonator comprising the steps of positioning a dielectric resonator between two films of P.T.F.E., positioning an intermediate layer of a tetraflouroethylene copolymer between said P.T.F.E. layers, followed by the application of heat and pressure to effect a bond between said two P.T.F.E. layers.

14. A microwave dielectric resonator assembly comprising:

at least one microwave dielectric resonator having a predetermined external thickness dimension and a predetermined first dielectric constant;

plural polymeric layers having a predetermined second dielectric constant less than said first constant and having a thickness dimension less than the external resonator thickness dimension, at least one of said plural polymeric layers being disposed on each side of said resonator, and said plural polymeric layers being heat-pressure laminated together about the external edges of said resonator end extending therebeyond to provide a support structure for the resonator.

15. A microwave dielectric resonator assembly as in claim 14 wherein the outermost pair of said plural polymeric layers comprise polymeric films having thickness on the order of one-tenth the thickness of the resonator or less.

16. A microwave dielectric resonator assembly as in claim 14 further comprising:

a waveguide including two sections clamped against the edges of said laminated layers so as to mount said at least one resonator within a waveguide cavity.

* * * * *

UNITED STATES PATENT AND TRADEMARK OFFICE

CERTIFICATE OF CORRECTION

PATENT NO. : 4,563,662

DATED : January 7, 1986

INVENTOR(S) : William Thrope

It is certified that error appears in the above-identified patent and that said Letters Patent is hereby corrected as shown below:

The title page showing the illustrative figure should be deleted to appear as per attached title page. The three (3) sheets of drawing should be deleted to be replaced with the five (5) sheets of drawings as shown on the attached sheets.

Signed and Sealed this

*Twenty-fourth* Day of *June 1986*

[SEAL]

*Attest:*

DONALD J. QUIGG

*Attesting Officer*

*Commissioner of Patents and Trademarks*

United States Patent [19]

Thorpe

[11] Patent Number: 4,563,662

[45] Date of Patent: Jan. 7, 1986

[54] MOUNTING DIELECTRIC RESONATORS

[75] Inventor: William Thorpe, Felixstowe, England

[73] Assignee: British Telecommunications, London, England

[21] Appl. No.: 523,059

[22] Filed: Aug. 15, 1983

[30] Foreign Application Priority Data

May 25, 1983 [GB] United Kingdom ..... 8314460

[51] Int. Cl.[4] ..... H01P 7/00; H01P 1/207; H01P 1/203

[52] U.S. Cl. ..... 333/219; 333/202; 333/204, 333/208

[58] Field of Search ..... 333/202-212, 333/219-227; 428/901; 29/600; 331/96, 101, 102, 107 DP, 107 SL

[56] References Cited

U.S. PATENT DOCUMENTS

| | | | |
|---|---|---|---|
| 3,237,132 | 2/1966 | Okaya | 333/208 X |
| 4,028,650 | 6/1977 | Konishi et al. | 333/210 |
| 4,321,568 | 3/1982 | Joyal et al. | 333/209 |

FOREIGN PATENT DOCUMENTS 279127 4/1952 Switzerland .

OTHER PUBLICATIONS

Zeitschrift fur Angewandte Physik, vol. 24, No. 3, Mar. 1968, Berlin (DE), H. M. Muller: "Dielektrische Resonatoren und ihre Anwendungen als Mikrowellenfilter", pp. 142-147.

IEEE Transactions on Microwave Theory and Techniques, "Application of Dielectric Resonators in Microwave Components", by James K. Plourde et al., vol. MTT-29, No. 8, Aug. 1981.

IEEE Transactions on Microwave Theory & Techniques, vol. MTT-29, No. 4, Apr. 1981, pp. 323-326, New York (US), R. R. Bonetti et al.: "Designe of Cylindrical Dielectric Resonators in Inhomogeneous Media."

Patents Abstracts of Japan, vol. 6, No. 173, P (E-129) (1051), Sep. 7, 1982, and JP-A-5 7 91 001 (Matsushita Denki Sangyo KK) (07-06-1982).

*Primary Examiner*—Marvin L. Nussbaum

*Attorney, Agent, or Firm*—Cushman, Darby & Cushman

[57] ABSTRACT

A microwave dielectric resonator is supported between plural laminated layers of polymeric material having relatively lower dielectric constant.

16 Claims, 8 Drawing Figures

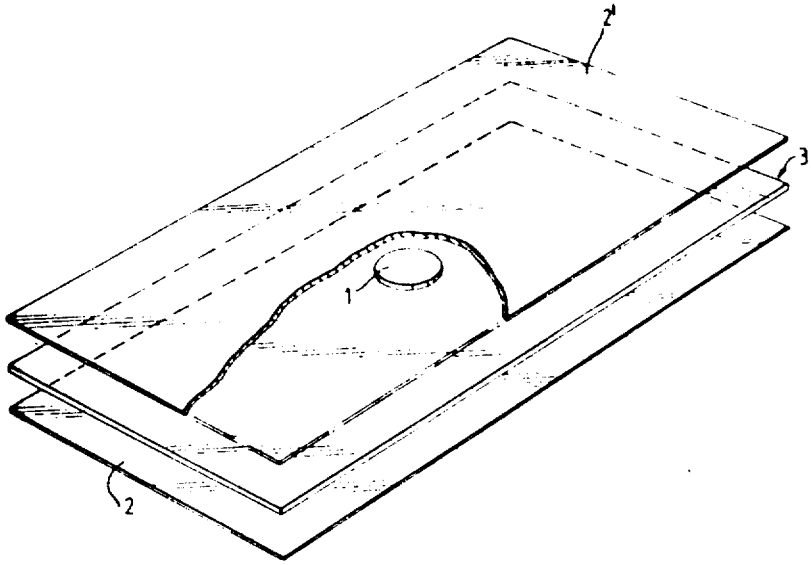

UNITED STATES PATENT AND TRADEMARK OFFICE

CERTIFICATE OF CORRECTION

PATENT NO. : 4,563,662

DATED : January 7, 1986

INVENTOR(S) : Thorpe

It is certified that error appears in the above-identified patent and that said Letters Patent is hereby corrected as shown below:

Sheet 1 of the drawings should read "Sheet 1 of 5" and should show:

Fig.1.

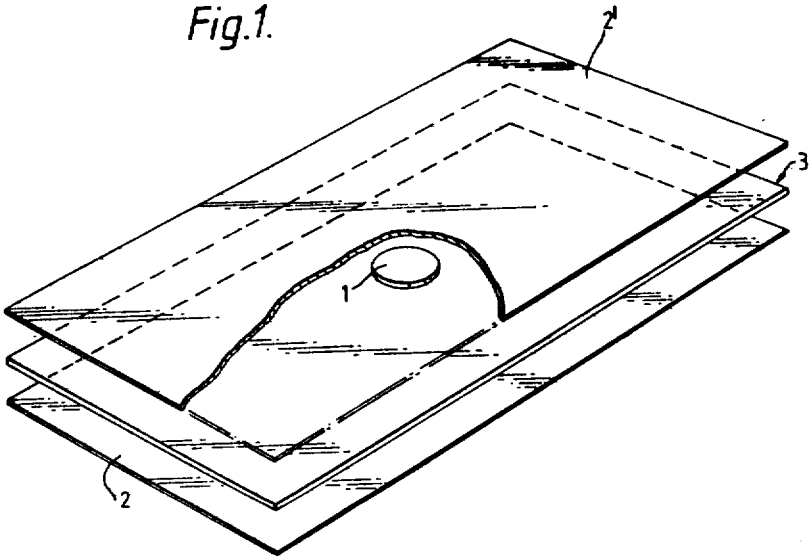

Fig.1A.

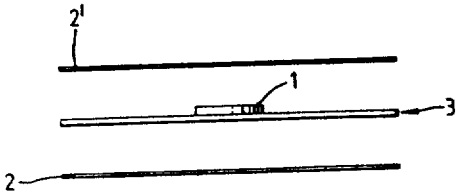

UNITED STATES PATENT AND TRADEMARK OFFICE

CERTIFICATE OF CORRECTION

PATENT NO. : 4,563,662

DATED : January 7, 1986

INVENTOR(S) : Thorpe

It is certified that error appears in the above-identified patent and that said Letters Patent is hereby corrected as shown below:

Sheet 2 of the drawings should read "sheet 2 of 5" and should show:

Fig.2.

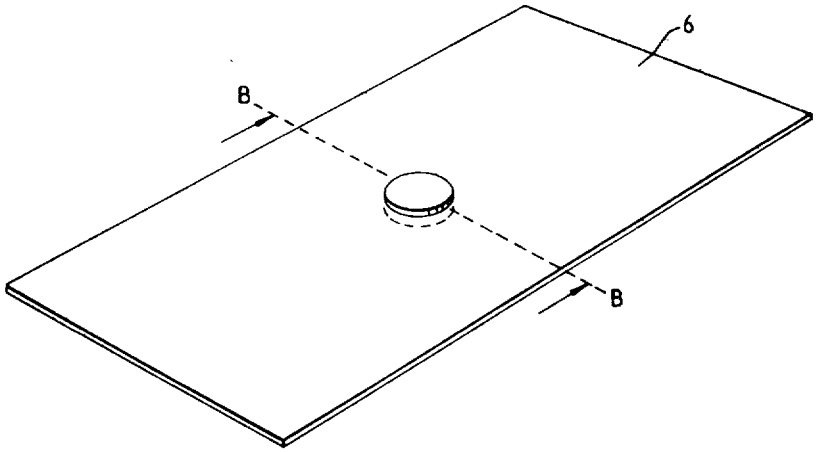

Fig.2A.

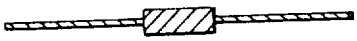

UNITED STATES PATENT AND TRADEMARK OFFICE

CERTIFICATE OF CORRECTION

PATENT NO. : 4,563,662 Page 5 of 7

DATED : January 7, 1986

INVENTOR(S) : Thorpe

It is certified that error appears in the above-identified patent and that said Letters Patent is hereby corrected as shown below:

Sheet 3 of the drawings should read "sheet 3 of 5" and should show:

Fig. 3.

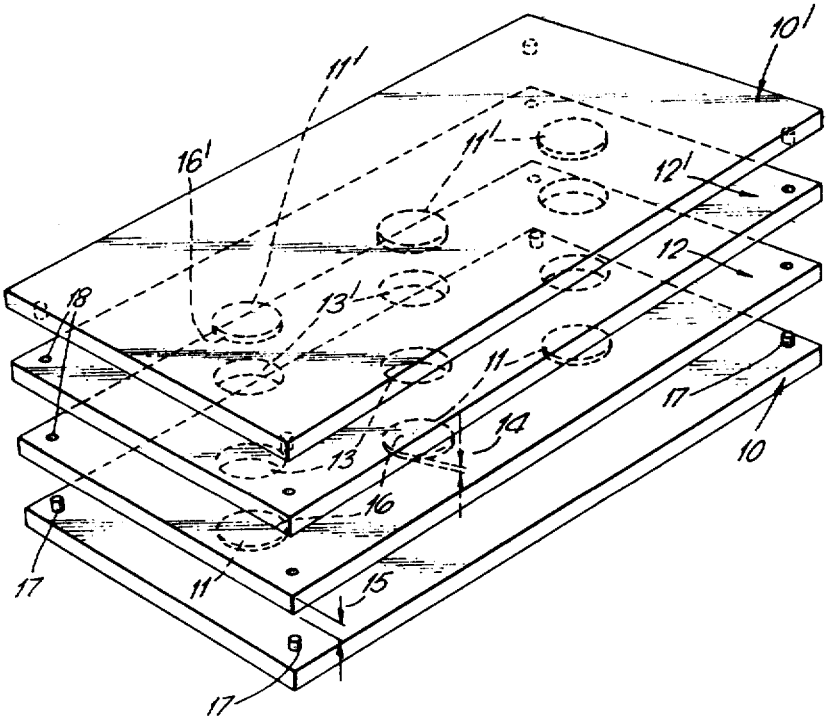

UNITED STATES PATENT AND TRADEMARK OFFICE

CERTIFICATE OF CORRECTION

PATENT NO. : 4,563,662

DATED : January 7, 1986

INVENTOR(S) : Thorpe

It is certified that error appears in the above-identified patent and that said Letters Patent is hereby corrected as shown below:

Add "Sheet 4 of 5" which shows:

Fig.4.

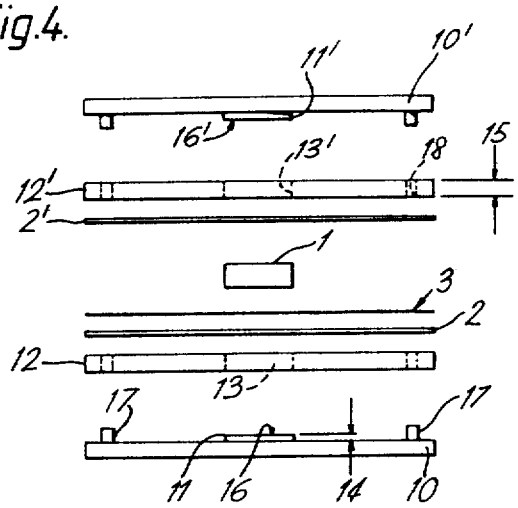

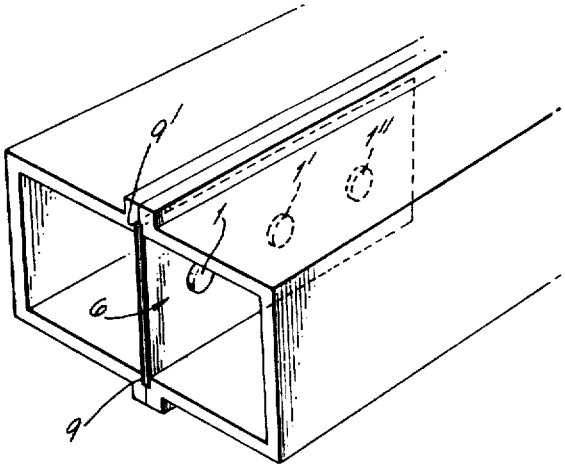

Fig. 5.

UNITED STATES PATENT AND TRADEMARK OFFICE

CERTIFICATE OF CORRECTION

PATENT NO. : 4,563,662

DATED : January 7, 1986

INVENTOR(S) : Thorpe

It is certified that error appears in the above-identified patent and that said Letters Patent is hereby corrected as shown below:

Add "Sheet 5 of 5" which shows:

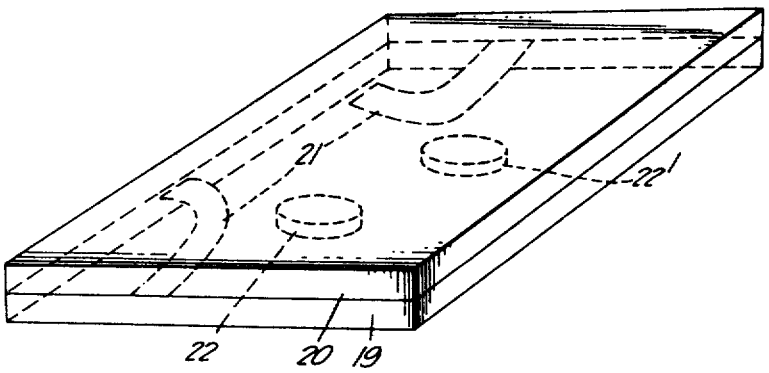

Fig. 6.